United States Patent [19]

Gordon

[11] 4,228,926

[45] Oct. 21, 1980

[54] DISPENSING VISCOUS FLUIDS

[75] Inventor: Alan J. Gordon, Liverpool, England

[73] Assignee: Shandon Southern Products Limited, Cheshire, England

[21] Appl. No.: 883,465

[22] Filed: Mar. 6, 1978

[51] Int. Cl.[3] ..... B67D 3/00

[52] U.S. Cl. ..... 222/103; 222/212; 251/7

[58] Field of Search ..... 222/95, 103, 206, 209, 222/212, 214, 215, 1; 251/4–7, 9–10

[56] References Cited

U.S. PATENT DOCUMENTS

| | | | |
|---|---|---|---|
| 2,533,839 | 12/1950 | Robinson | 222/103 |
| 2,884,165 | 4/1959 | Moeller | 222/214 X |
| 3,790,029 | 2/1974 | Ward | 222/129.4 |
| 3,877,609 | 4/1975 | Cullis | 222/214 X |
| 3,998,103 | 12/1976 | Björklund et al. | 222/215 X |
| 4,030,640 | 6/1977 | Citrin et al. | 222/214 X |

FOREIGN PATENT DOCUMENTS

| | | | |
|---|---|---|---|
| 1163162 | 9/1969 | United Kingdom | 222/206 |

*Primary Examiner*—Joseph J. Rolla
*Attorney, Agent, or Firm*—Kurt Kelman

[57] ABSTRACT

Viscous fluids are dispensed intermittently in regulated quantities from a body of such a fluid held under maintained pressure and under the control of a control valve in a fluid flow path positioned at a significant distance upstream of a discharge point, the flow path between the control valve and the discharge point having its contained volume adjusted in coordination with operation of the control valve so that as the valve closes the volume is increased to prevent exudation of fluid at the discharge point.

12 Claims, 3 Drawing Figures

DISPENSING VISCOUS FLUIDS

FIELD OF THE INVENTION

The invention concerns the dispensing of viscous fluids, a term used herein to define liquids, slurries, pastes and semi-liquids that have a relatively high viscosity but that nevertheless are capable of being pumped or otherwise caused to flow through a conduit.

BACKGROUND TO THE INVENTION

In many technical and industrial applications it is required to dispense, for instance, an adhesive or like viscous fluid in a controlled manner so that a required quantity of the fluid is dispensed, e.g. discharged from a nozzle, within a predetermined period of time.

In some cases the amount of fluid to be dispensed is rather small, for instance one or a few drops, and the accurate dispensing of such small quantities is difficult to accomplish. One of the reasons for such difficulty is that the force needed to cause flow of the fluid and its discharge from, say, a nozzle, involves significant pressures being developed in the fluid upstream of the discharge point or nozzle so that if a flow-control valve is disposed a significant distance upstream of the discharge point, fluid flow tends to continue at the discharge point after the control valve has been closed, as a result of expansion of the fluid in the conduit between the valve and the discharge point, and, possibly, as a result of relaxation by contraction of the conduit when this is resilient. In the case of some fluids this additional flow or exudation at the discharge point may give rise to problems such as a change in the character of the fluid while exposed to the external atmosphere at the discharge point—for instance an adhesive may commence setting or curing—and this may in some cases affect the subsequent discharge of fluid, or degrade the fluid subsequently discharged.

THE INVENTION

An objective of the invention is to provide a method of effecting controlled intermittent discharge of viscous fluid that at least substantially avoids the aforesaid problems. A further objective of the invention is to provide a dispensing apparatus suitable for dispensing viscous fluid, especially in small quantities, at a discharge point disposed at a significant distance from a valve controlling the flow of fluid to the discharge point.

In one aspect, therefore, the invention provides a method of dispensing a viscous fluid, comprising maintaining such a fluid under pressure in a flow path upstream of a control valve having fluid flow connection to a discharge orifice; inducing flow of fluid to said orifice by opening said valve while concurrently reducing the volume of the fluid flow path between said valve and said orifice; and thereafter closing said control valve while concurrently increasing the volume of said flow path by an amount at least sufficient to accommodate any expansion of the fluid in said flow path.

Preferably the said increase in volume of the flow path upon closing the control valve exceeds any likely expansion of the fluid in the flow path so that the fluid tends to be drawn back into the flow path from the vicinity of the discharge point, thereby minimising risk of exudation of fluid or the formation of external drops at the discharge point.

If said flow path is constituted at least in part by a conduit liable to expand in response to the pressure of the fluid therein when said control valve is open, the said step of increasing the flow path volume upon closing the control valve must at least compensate for the resultant contraction of the said conduit in response to falling pressure in the fluid.

Conveniently the required reduction in flow path volume may be accomplished by external compression of a resilient conduit forming part of said flow path. Removal of the force causing such compression may then serve to accomplish the required increase in flow path volume when the control valve is closed.

The invention further includes apparatus for the aforesaid purposes and thus in a further aspect the invention provides apparatus for controlling the flow of a viscous fluid, comprising pressurising means for maintaining a body of such a fluid under pressure sufficient to cause flow thereof through a flow path to a discharge point; a control valve in said flow path and spaced upstream of said discharge point; and means for adjusting the volume of said flow path between said control valve and said discharge point in coordination with the operation of said control valve so that said volume is reduced concurrently with opening of the control valve and is increased concurrently with closing of said control valve.

The pressurising means for maintaining the body of viscous fluid under pressure may take any convenient form, depending upon the nature of the fluid and any procedures that have to be applied thereto. For instance it may in some instances be necessary to heat or otherwise control the temperature of the fluid and in such cases the means for maintaining the fluid under pressure may be incorporated in suitable means for heating or controlling the temperature of the fluid. The pressurising means may be mechanical in nature and comprise, for instance, a pump or a container having a deflectable wall subject to external force to decrease the container volume. Alternatively the pressurizing means may involve the application of fluid—e.g. inert gas—pressure directly or indirectly to the body of viscous fluid to be dispensed.

In a preferred embodiment of the invention, the pressurising means comprise a flexible tubular container sealed at one end and having an outlet at its other end, and a pair of pressure plates between which the said container is located, spring or like resilient means being arranged to tend to close the pressure plates upon the container so as thereby to tend to squeeze a viscous fluid contained therein from the container outlet.

Conveniently said pressure plates are hingedly connected and the container is arranged with its sealed end nearer to the hinge connection.

The container may at least in part be constituted by the normal packaging of the viscous fluid to be dispensed.

In one convenient form of this preferred arrangement, the pressure plates are connected by a toggle linkage including a pair of spring links that in one overcentre condition of the linkage act to urge the pressure plates together.

The control valve may take any suitable form but is conveniently a pinch valve comprising a resilient conduit forming part of said flow path and means for squeezing or pinching that conduit to occlude its bore. Such a valve, may, for instance, be solenoid operated.

The means for adjusting the volume of the flow path between the control valve and the discharge point may conveniently comprise a length of resilient conduit constituting part of the flow path downstream of the control valve and means for compressing a part of that conduit so as partly to occlude its bore to effect a reduction in the bore volume of that part of the conduit. When the control valve is a solenoid-operated pinch valve of the construction mentioned, the volume-adjusting means may be of similar form and be actuated by the same solenoid as the control valve, but in the opposite sense.

Thus in a preferred embodiment, a resilient conduit forming part of the said flow path extends between rigid supports and a pair of fingers carried by a plunger that is spring biased in one direction and coupled to a solenoid for movement thereby in the other direction, said fingers engaging longitudinally spaced parts of the conduit and being so arranged that in one condition of the solenoid the upstream finger pinches the conduit against one support completely to occlude the conduit bore whereas in the other condition of the solenoid the downstream finger pinches the conduit against the other support partly to occlude the conduit bore.

Although the method and apparatus of the invention have many potential applications, a particularly useful application is in connection with dispensing small quantities of mountant fluid onto microscope slides or cover slips therefor in an automatic microscope slide cover-slipping machine, for instance a machine such as that disclosed in the copending Application Ser. No. 833,466 of Kenneth J. Henderson and Alan J. Gordon filed concurrently herewith.

THE DRAWINGS

FIG. 1 is an exploded perspective view of a microscope slide cover slip mountant fluid dispenser embodying the invention; and FIGS. 2 and 3 are diagrammatic illustrations of the control valve and volume-adjusting means of the dispenser in FIG. 1, showing the control valve in its closed and open conditions, respectively.

DESCRIPTION OF PREFERRED EMBODIMENT

Figure 1:
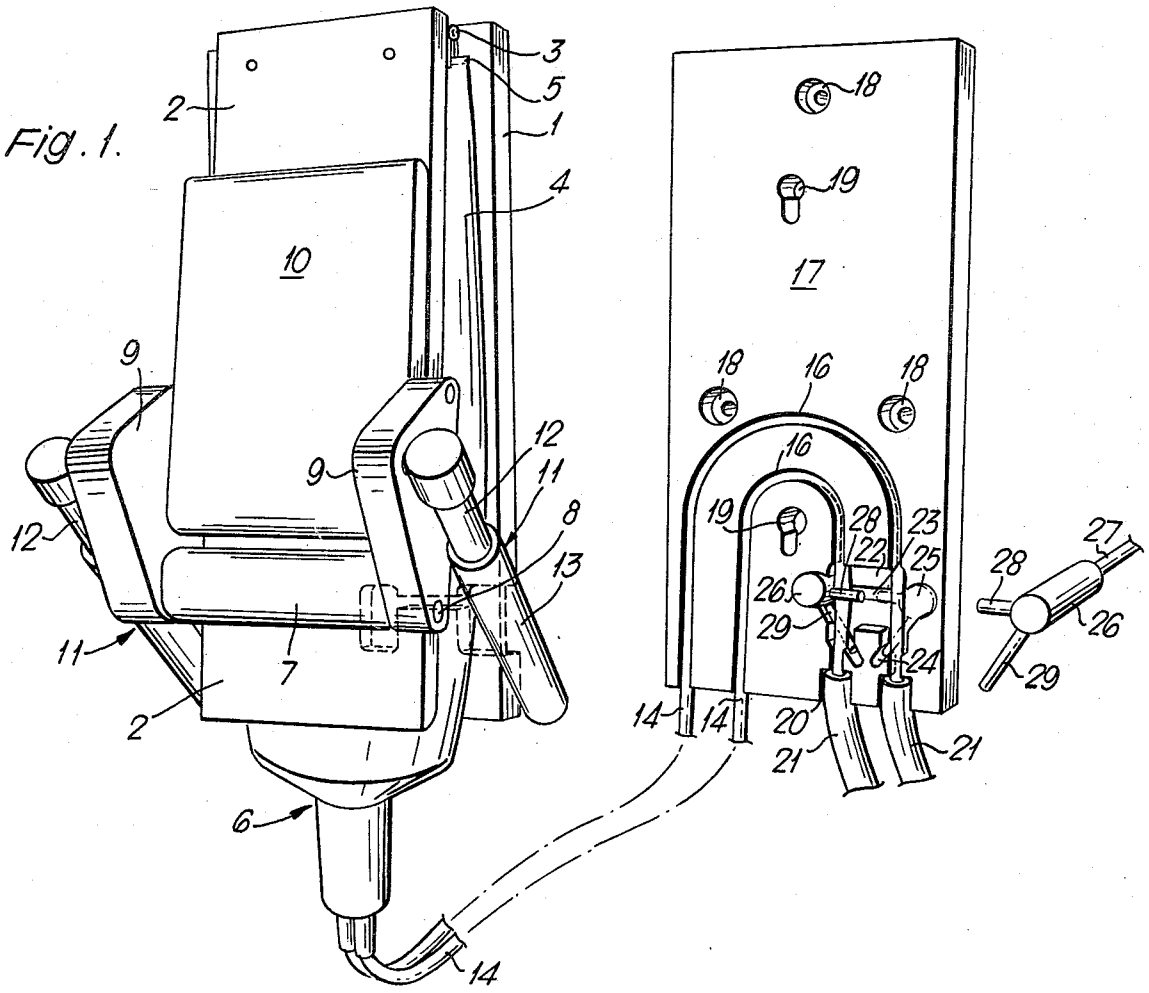

The dispenser shown in FIG. 1 is intended to dispense microscope slide cover slip mountant or fixative fluid that is obtainable packed in tubular containers that are sealed at one end and have a capped opening at their other end and through which the mountant may be discharged by squeezing the container. Accordingly the illustrated apparatus is intended to utilise the original packing of the mountant as part of the means for pressurising a body of the fluid.

The apparatus shown in FIG. 1 comprises a pair of pressure plates 1, 2 connected by a hinge 3 and between which the aforesaid packing container 4 of a body of mountant fluid may be positioned with its sealed end 5 adjacent to the hinge 3 and its outlet-provided end 6 extending from between the pressure plates 1 and 2.

The pressure plate 2 has an upstanding transverse rib 7 on its outer surface near the free end thereof and this rib has trunnions constituted by the ends of a rod 8 that provides a pivotal connection to each of a pair of triangular toggle links 9 that are fixed to a toggle lever 10 whereby the links 9 may be rocked about the rod ends 8. The links 9 are each pivotally connected to an individual telescopic spring link 11 that consists of a plunger 12 reciprocable in a housing 13 that is pivoted to the pressure plate 1 near the free end thereof and that contains a spring acting on the plunger 12 so as to tend to contract the length of the link 11. In the condition of the parts shown in FIG. 1, the spring links 11 act through the links 9 and rib 7 to urge the free end of the pressure plate 2 towards the pressure plate 1 and thereby tend to squeeze the container 4 and so maintain a pressure upon the fluid contents of the container 4.

It will be apparent that by pulling the lever 10 forwardly and downwardly to rock the links 9 about the rod ends 8, the spring links 11 will move over-centre and permit the pressure plate 2 to pivot about the hinge 3 away from the pressure plate 1 for the purpose of relieving the pressure applied to the container 4 and to facilitate the removal of the latter and its substitution by another such container.

The illustrated dispenser further includes twin combined control valve and volume-adjusting assemblies for controlling the flow of fluid from the container 4 to a pair of discharge points. The flow path to each discharge point consists in part of an individual resilient tube 14 that extends from a cap 15 fitted to the open end of the container 4, to and through an individual channel 16 formed in a mounting plate 17 that although shown separated from the pressure plate 1 in FIG. 1 is in fact fitted to the rear (hidden) face of the pressure plate 1 so that the channels 16 are closed by the rear surface of the plate 1. The mounting plate 17 is provided with counterbore holes 18 through which fixing bolts or the like may extend to secure the plate 17 to a supporting structure. The mounting plate 17 is further provided with a pair of keyhole slots 19 for cooperation with fixing bolts (not shown) on the rear face of the pressure plate 1 to secure the mounting plate 17 thereto.

The channels 16 in the mounting plate 17 are of horseshoe shape as shown and each terminates in an individual enlarged recess 20 that receives the end of a flexible discharge conduit 21 that is connected to the relevant tube 14 in the associated channel 16.

The tubes 14 extend through the recess 22, passing over a rib 23 and an angled channel 24.

Laterally outboard of each tube 14 as it passes through the recess 22 is a hole 25 through which extends, reciprocably, an individual plunger 26 coupled by a rod 27 to an operating solenoid and spring-loading assembly (not shown).

Each plunger 26 is fitted with a pair of fingers 28, 29 respectively that project radially from the plunger 26 at positions spaced longitudinally thereof by a distance approximating the diameter of the associated tube 14.

The finger 29 lies in the associated angled channel 24 and thus underneath the tube 14 whereas the finger 28 lies over the tube 14 and parallel with the rib 23.

Figure 2:
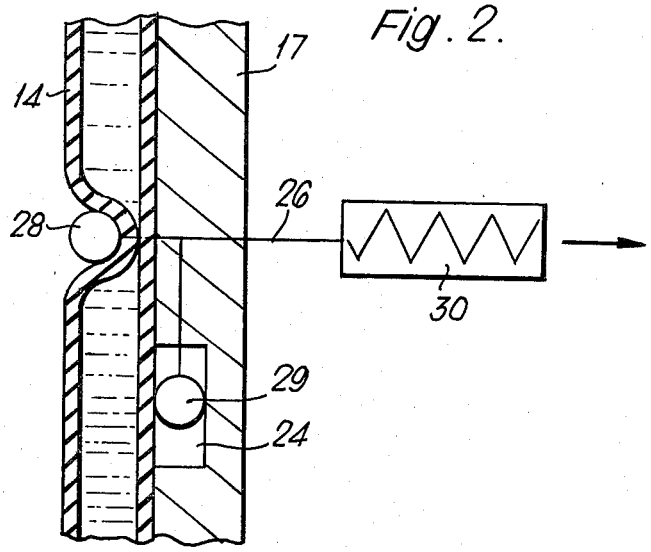
Figure 3:
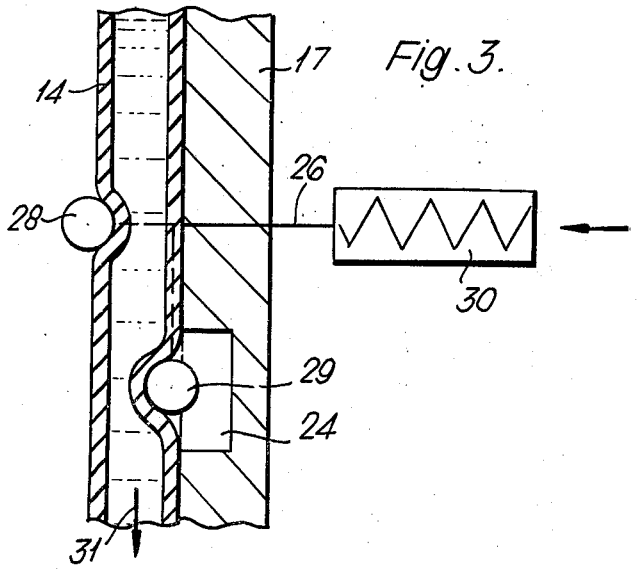

The operation of each flow control valve and volume-adjusting assembly constituted by one of the solenoid-operated plungers 26 and its fingers 28 and 29 in cooperation with the associated tube 14 is best understood from a consideration of FIGS. 2 and 3. In these figures the actuating solenoid and spring-loading unit for a plunger 26 is shown diagrammatically at 30 and the rib 23 has been omitted for ease of illustration, as has also the pressure plate 1, the hidden face of which is recessed in the region of the plunger 26 and finger 28 to permit movement to the condition shown in FIG. 3, but which lies against the tube 14 in the region opposite to the angled channel 24 and finger 29 so as to provide a support against which the tube 14 may be compressed by the finger 29 in the manner shown in FIG. 3.

FIG. 2 shows the condition of the parts when the plunger 26 has been moved fully rearwardly of the mounting plate 17, i.e. in the direction indicated by the arrow in FIG. 2. Typically this will be the position resulting from deenergisation of the solenoid of the unit 30, movement of the plunger 26 to this position being caused by the spring of the unit 30. This position represents the closed condition of the flow control valve comprising the finger 28 that, as shown, pinches the tube 14 (in practice against the rib 23) so as totally to occlude the tube bore and thus prevent fluid flow therethrough. On the other hand in this position of the plunger 26, the finger 29 is fully housed in the angled channel 24 and thus imposes no constraint upon the tube 14.

FIG. 3 shows the position of the parts when the plunger 26 has moved fully forward—i.e. in the direction indicated by the arrow in FIG. 3. This condition of the parts particularly results from energisation of the solenoid of the unit 30 so that it overcomes the spring-loading tending to move the parts to the FIG. 2 condition.

In the condition illustrated in FIG. 3, the finger 28 no longer pinches the tube 14 to occlude its bore and prevent flow of fluid through the tube (in the direction of the arrow 31); however the finger 29, as shown, compresses a portion of the tube 14 downstream of the control valve (finger 28) and partly occludes the tube bore at this region, thereby to reduce the effective total volume of the flow path constituted by the tube 14 and associated conduit 21 downstream of the control valve.

It will be apparent that in moving from the valve-open position of FIG. 3 to the valve-closed position of FIG. 2, the finger 29 will release its compressive load on the tube 14 and so permit this to re-expand to its natural bore cross section and therefore increase its volume downstream of the control valve so as to accommodate expansion of the fluid in the tube 14 and conduit 21 so as to prevent exudation of the fluid at the discharge point fed by the conduit 21.

Preferably the volume adjustment effected by the movement of the finger 29 exceeds the likely change in contained fluid volume and also any change in the flow path volume resulting from changes in internal pressure, so that upon closing of the control valve there is a tendency for fluid within the flow path near the discharge point to be pulled back into the flow path and thereby partly shrouded from the ambient atmosphere in the region of the discharge point.

I claim:

1. A method of dispensing a viscous fluid from a discharge orifice in a fluid flow path constituted at least in part by the bore of a resilient conduit, comprising (a) feeding the fluid under a constantly maintained pressure to a pinch valve movable between an open and closed position and capable of squeezing or pinching the conduit in the closed position to occlude the bore of the conduit;

(b) inducing flow of fluid through the bore of the conduit to said orifice by moving said pinch valve into the open position while concurrently squeezing or pinching a part of said conduit downstream of the pinch valve so as partly to occlude the bore of the conduit, and effect a reduction in the bore volume of that part of the conduit; and (c) thereafter moving said pinch valve into the closed position while concurrently releasing said conduit part downstream of said pinch valve to increase the volume of said part of the conduit by an amount at least sufficient to accommodate any expansion of the fluid in said downstream conduit part.

2. The method of claim 1 in which said increase in volume exceeds any likely expansion of the fluid.

3. Apparatus for controlling the flow of a viscous fluid, comprising (a) means for maintaining a body of said fluid under a pressure sufficient to cause flow thereof to a discharge point through a flow path constituted at least in part by the bore of a length of resilient conduit;

(b) a pinch valve comprising means for moving the pinch valve between an open position wherein the bore permits flow of the fluid to the discharge point and a closed position wherein the valve squeezes or pinches the resilient conduit to occlude bore of the conduit; and (c) volume-adjusting means for alternately squeezing or pinching and opening a part of said resilient conduit downstream of said pinch valve so as partly to occlude the bore of the conduit on squeezing or pinching the conduit to effect a reduction in the bore volume of said part of the conduit in coordination with moving said pinch valve into the open position so that said bore volume is reduced concurrently with opening of the pinch valve and is increased concurrently with closing of said pinch valve.

4. The apparatus of claim 3 in which said pinch valve is solenoid operated.

5. The apparatus of claim 3, wherein the means for maintaining the body of fluid under pressure includes means for applying a fluid pressure to the body of viscous fluid.

6. The apparatus of claim 3, wherein the volume-adjusting means is a further pinch valve and the pinch valves are actuated by a common solenoid.

7. The apparatus of claim 3 in which said means for maintaining the body of fluid under pressure comprises a flexible tubular container sealed at one end and having an outlet at its other end, and a pair of pressure plates between which the said container is located, resilient means being arranged to tend to close the pressure plates upon the container.

8. The apparatus of claim 7 in which said pressure plates are hingedly connected and the container is arranged with its sealed end nearer to the hinge connection.

9. The apparatus of claim 3 in which said volume-adjusting means is a further pinch valve.

10. The apparatus of claim 9, wherein the further pinch valve is solenoid operated.

11. Apparatus for controlling the flow of a viscous fluid, comprising (a) two rigid supports;

(b) means for maintaining a body of said fluid under a pressure sufficient to cause flow thereof to a discharge point through a flow path constituted at least in part by the bore of a length of resilient conduit extending between said supports;

(c) a pair of fingers respectively constituting a pinch valve and a means for adjusting the bore volume of a part of said resilient conduit downstream of the pinch valve;

(d) a plunger movably mounted in one of the supports for movement transversely to the flow path, the plunger carrying the fingers and the fingers projecting from the plunger to engage an upstream and a downstream part at opposite sides of the conduit, the conduit extending between the upstream and downstream fingers;

(e) spring means urging the plunger in a first direction to cause the upstream finger to squeeze or pinch the conduit against the one support to occlude the bore of the conduit whereby the pinch valve is moved between an open position wherein the bore permits flow of the fluid to the discharge point and a closed position wherein the bore is occluded; and (f) a solenoid connected to the plunger and adapted to overpower said spring means to cause the downstream finger to squeeze or pinch the conduit against the other support so as to partly occlude the bore of the conduit whereby the downstream part of said resilient conduit is alternately squeezed or pinched and opened, the bore being partly occluded on squeezing or pinching the conduit to effect a reduction in the bore volume of said part of the conduit in coordination with moving the pinch valve into the open position so that said bore volume is reduced concurrently with opening of the pinch valve and is increased concurrently with closing of said pinch valve.

12. Apparatus for controlling the flow of a viscous fluid, comprising (a) means for maintaining a body of said fluid under a pressure sufficient to cause flow thereof to a discharge point through a flow path constituted at least in part by the bore of a length of resilient conduit, said means including (1) a flexible tubular container sealed at one end and having an outlet at its other end, (2) a pair of hingedly connected pressure plates between which the said container is located with its sealed end nearer to the hinge connection, and (3) a toggle linkage including a pair of spring links connecting the pressure plates, the spring links acting to urge the pressure plates together against the container in an over-center condition of the linkage;

(b) a pinch valve comprising means for moving the pinch valve between an open position wherein the bore permits flow of the fluid to the discharge point and a closed position wherein the valve squeezes or pinches the resilient conduit to occlude bore of the conduit; and (c) volume-adjusting means for alternately squeezing or pinching and opening a part of said resilient conduit downstream of said pinch valve so as partly to occlude the bore of the conduit on squeezing or pinching the conduit to effect a reduction in the bore volume of said part of the conduit in coordination with moving said pinch volume into the open position so that said bore volume is reduced concurrently with opening of the pinch valve and is increased concurrently with closing of said pinch valve.

* * * * *